US006678496B1

(12) United States Patent
Aslam et al.

(10) Patent No.: US 6,678,496 B1
(45) Date of Patent: Jan. 13, 2004

(54) SKIVE MECHANISM FOR REPRODUCTION APPARATUS FUSER ROLLERS

(75) Inventors: Muhammed Aslam, Rochester, NY (US); Tsutomu Miura, Nagoya (JP); Fangsheng Wu, Rochester, NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 10/216,985

(22) Filed: Aug. 12, 2002

(51) Int. Cl.[7] ..... G03G 15/20
(52) U.S. Cl. ..... 399/323; 271/900
(58) Field of Search ..... 399/323, 322, 399/398, 399, 406, 92, 328, 320, 411; 219/469, 470, 471, 216; 271/307, 309, 311, 312, 900

(56) References Cited

U.S. PATENT DOCUMENTS 4,806,985 A * 2/1989 Foley et al. ..... 399/399
4,859,831 A * 8/1989 Webb ..... 219/216
4,866,485 A * 9/1989 Simpson ..... 399/323
5,448,347 A * 9/1995 Mills ..... 399/323
5,589,925 A * 12/1996 Cahill ..... 399/323
5,623,720 A * 4/1997 Howe et al. ..... 399/323
6,208,827 B1 * 3/2001 Aslam et al. ..... 399/323
6,295,436 B1 * 9/2001 Morganti et al. ..... 399/323
6,490,428 B1 * 12/2002 Fromm et al. ..... 399/323

* cited by examiner

*Primary Examiner*—Joan Pendegrass
(74) *Attorney, Agent, or Firm*—Lawrence P. Kessler

(57) ABSTRACT

A fuser apparatus having a pair of rollers in nip relation to transport a receiver member therebetween to permanently fix a marking particle image to such receiver member, and a skive mechanism for stripping a receiver member adhering to a fuser apparatus roller from the said roller. The skive mechanism includes a frame located in spaced relation with one of the rollers of the pair of fuser apparatus rollers. A plurality of skive assemblies, mounted on the frame, each include a skive finger and a support body for supporting such skive finger in operative relation to such one of the rollers. The skive fingers are elongated, thin, flexible members to substantially prevent damage to such associated fuser apparatus roller. Further, an air plenum is provided in operative relation to the other of the pair of rollers of the fuser apparatus rollers. The air plenum has a nozzle arrangement directed at an angle to the fuser apparatus roller associated with the air plenum so as to provide a positive air flow to substantially assure that a receiver member adhering to such fuser apparatus roller is stripped therefrom.

18 Claims, 10 Drawing Sheets

SKIVE MECHANISM FOR REPRODUCTION APPARATUS FUSER ROLLERS

FIELD OF THE INVENTION

The present invention relates in general to a skive mechanism for stripping receiver members from fuser apparatus rollers of reproduction apparatus, and more particularly to a skive mechanism including a contact skive assembly and an air skive for fuser apparatus rollers which will substantially prevent damage to the rollers and to the fused image on the receiver members stripped from the rollers.

BACKGROUND OF THE INVENTION

In typical commercial reproduction apparatus (electrostatographic copier/duplicators, printers, or the like), a latent image charge pattern is formed on a uniformly charged dielectric member. Pigmented marking particles are attracted to the latent image charge pattern to develop such image on the dielectric member. A receiver member is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser apparatus at a downstream location. There the image is fixed to the receiver member by heat and/or pressure from the fuser apparatus to form a permanent reproduction on the receiver member.

One type of fuser apparatus, utilized in typical reproduction apparatus, includes at least one heated roller and at least one pressure roller in nip relation with the heated roller. The fuser apparatus rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member.

Accordingly, upon cooling, the marking particle image is permanently fixed to the receiver member. It sometimes happens that the marking particles stick to the peripheral surface of the heated roller and result in the receiver member adhering to such roller; or the marking particles may stick to the heated roller and subsequently transfer to the peripheral surface of the pressure roller resulting in a receiver member adhering to the pressure roller.

In view of the receiver member adherence problem, a skive mechanism, including mechanical skive fingers or separator pawls for example, has been employed to engage the respective peripheral surfaces of the fuser apparatus rollers to strip any adhering receiver member from the rollers in order to substantially prevent receiver member jams in the fuser apparatus. Typically a fuser apparatus skive mechanism includes a plurality of skive fingers. The skive fingers are generally formed as elongated members respectively having a relatively sharp leading edge urged into engagement with a fuser apparatus roller. For example, the skive fingers may be thin, relatively flexible, metal shim stock. The respective leading edge of each of the skive fingers is directed in the opposite direction to rotation of the fuser apparatus roller with which such skive finger is associated so as to act like a chisel to strip any receiver member adhering to such roller from the peripheral surface thereof.

However, if the marking particle image is particularly dense, the receiver member may adhere to a fuser apparatus roller with such force that engagement with the skive fingers does not completely strip the receiver member from the roller. When a receiver member transported through the fuser apparatus is only stripped from a roller by some of the skive fingers (and not by others), the receiver member will cause a jam in the fuser apparatus. This destroys the reproduction formed on the receiver member and shuts down the reproduction apparatus until the receiver member is cleared from the fuser apparatus. Moreover, as the receiver member moves with the fuser apparatus roller to which it adheres, the stripped portions of the receiver member are forced into engagement with their associated skive fingers by the non-stripped portions of the receiver member. The engagement force of the receiver member on the skive fingers may be sufficient to flex those skive fingers so as to engage the associated peripheral surface of the fuser apparatus roller at a substantially increased attack angle. This increased attack angle may then damage the roller by gouging its peripheral surface or may damage the skive finger itself. Alternatively, as the receiver member is transported through the fuser apparatus, the receiver member may apply such force to the skive fingers on initial engagement therewith so as to cause such fingers to buckle in the direction which will flex those skive fingers to engage the associated fuser apparatus roller at an increased attack angle. Again, this increased attack angle may damage the roller by gouging its peripheral surface or may damage the skive finger itself.

It has been shown in U.S. Pat. No. 5,532,810 (issued Jul. 2, 1996, in the name of Cahill); U.S. Pat. No. 5,589,925 (issued Dec. 31, 1996, in the name of Cahill); and U.S. Pat. No. 6,029,039 (issued Feb. 22, 2000, in the name of Aslam et al.) that providing elongated skive fingers of limited flexibility mounted respectively in particularly configured support bodies substantially prevents damaging flex of the skive fingers. In these prior skive mechanisms, the support bodies support a major portion of the skive fingers and pivot into engagement with the fuser roller to limit skive finger flexing when engaged by a receiver member to be stripped from a fuser roller. The skive fingers are also shown as being retractable to prevent damage induced by jammed receiver members.

Another skive mechanism, which can overcome problems generated by mechanical skive fingers, includes air jets directed at the rollers to strip any adhering receiver member from the rollers (see for example U.S. Pat. No. 4,420,152 (issued Dec. 13, 1983, in the name of Miyashita). It provides an air chamber with exhaust nozzles which direct escaping air at high speeds for separating receiver members from the fuser rollers. However such arrangement creates a high pressure area near the fusing nip and a low pressure area adjacent to the air skive. Thus after a receiver member is stripped from a fuser roller it is attracted to the skive structure. Since the skive structure is close to the fuser roller, it is at an elevated temperature. Accordingly, the hot skive structure may scratch the image on the receiver member or damage the receiver member itself.

SUMMARY OF THE INVENTION

In view of the above, this invention is directed to a fuser apparatus having a pair of rollers in nip relation to transport a receiver member therebetween to permanently fix a marking particle image to such receiver member, and a skive mechanism for stripping a receiver member adhering to a fuser apparatus roller from the said roller. The skive mechanism includes a frame located in spaced relation with one of the rollers of the pair of fuser apparatus rollers. A plurality of skive assemblies, mounted on the frame, each include a skive finger and a support body for supporting such skive finger in operative relation to such one of the rollers. The skive fingers are elongated, thin, flexible members to substantially prevent damage to such associated fuser apparatus roller. Further, an air plenum is provided in operative relation to the other of the pair of rollers of the fuser apparatus rollers. The air plenum has a nozzle arrangement directed at an angle to the fuser apparatus roller associated with the air plenum so as to provide a positive air flow to substantially assure that a receiver member adhering to such fuser apparatus roller is stripped therefrom.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
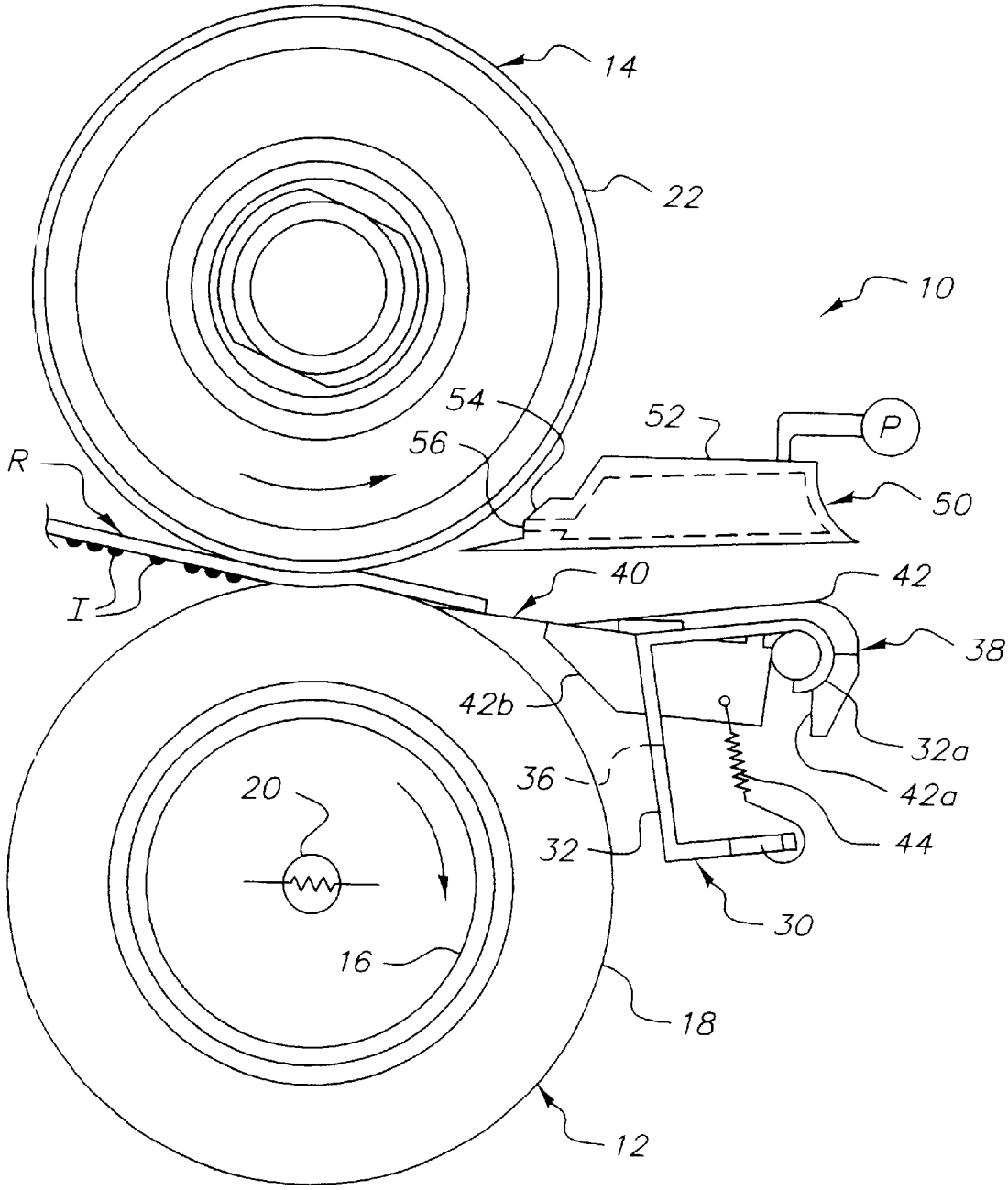
FIG. 1 is a side elevational view of a reproduction apparatus fuser having a receiver member skive assembly, according to this invention, with portions removed or broken away to facilitate viewing.

Referring now to the accompanying drawings, FIG. 1 shows a typical fuser apparatus, designated generally by the numeral 10, for a common commercial electrographic reproduction apparatus. The fuser apparatus 10 includes a fuser roller 12 in nip relation with a pressure roller 14. Rotation of the fuser rollers by any suitable drive mechanism (not shown) will serve to transport a receiver member (designated for example by the letter R in FIG. 1), bearing a marking particle image I, through the nip under the application of heat and pressure. The receiver member may be, for example, a sheet of plain bond paper, or transparency material. The heat will soften the marking particles and the pressure will force the particles into intimate contact with each other and with the surface of the receiver material, such that the particles are at least partially imbibed into the receiver material fibers. Thus, when the marking particles cool, they are permanently fixed to the receiver member in an image-wise fashion.

The fuser roller 12 includes a core 16 with a cylindrical fusing blanket 18 supported on the core. The blanket 18 is typically made of a rubber material particularly formulated to be heat conductive or heat insulative depending upon whether the fuser heat source is located within the core 16 or in juxtaposition with the periphery of the blanket. In the illustrated preferred embodiment as shown in FIG. 1, the heat source is an internal heater lamp designated by the numeral 20. A well known suitable surface coating (not shown) may be applied to the blanket 18 to substantially prevent offsetting of the marking particle image to the fuser roller 12.

The pressure roller 14 has a hard outer shell 22. Typically, the shell 22 is made of metal, such as aluminum or steel for example. The shell 22 may also have a well known suitable surface coating (not shown) applied thereto to substantially prevent offsetting of the marking particle image to the pressure roller 14. Further, a cleaning assembly (not shown) may be provided to remove residual marking particle, paper fibers, and dust from the fuser apparatus rollers.

As noted above, under certain circumstances, such as when fusing heavy marking particle images, the receiver member may adhere to one or the other of the fuser apparatus rollers (i.e., fuser roller 12 or pressure roller 14). Therefore, a skive mechanism, designated generally by the numeral 30, is provided according to this invention. The skive mechanism 30, shown in FIG. 1 in operative relation with the fuser roller 12, includes a frame 32 having a portion 32*a* mounted on a pivot rod 34. The pivot rod 34 has its longitudinal axis parallel to the longitudinal axis of the fuser roller 12, and extends for a length substantially equal to the length of the fuser roller. The frame 32 defines a plurality of openings 36 for a plurality of skive finger assemblies 38 respectively (see FIG. 2). A resilient member 44 (see FIG. 1), such as a coil spring, urges the frame 32 in a direction about the pivot rod 34 to maintain the skive assemblies of the skive mechanism in operative engagement with the fuser roller.

Each skive finger assembly 38 includes a skive finger 40 and a skive finger support 42. The skive finger 40 is formed as an elongated, substantially planar, relatively flexible element having a sharp chisel-like leading edge (for example, formed from a thin metal sheet). The skive finger support 42 is formed as a main body having features for capturing and supporting a skive finger. The body of the skive finger support 42 includes a slot 42*a* and a lead edge 42*b*. The slot 42*a* is adapted to be received on the pivot rod 34 to locate each skive finger support 42 adjacent to a respective opening 36 such that the skive fingers 40 extend through the openings toward the fuser roller 12. When the skive finger support 42 is mounted on the pivot rod 34, the action of the resilient member 44 causes the lead edge of the skive finger 40 to contact the fuser roller, and the lead edge 42*b* to be normally spaced from the fuser roller 12. However, during certain jam conditions as discussed, the skive finger support 42 will pivot about the rod 34 until the lead edge 42*a* of the support engages the fuser roller 12. By so limiting the action of the skive fingers 40, damage to the fuser roller 12, or the skive fingers themselves, is substantially prevented.

Figure 2:
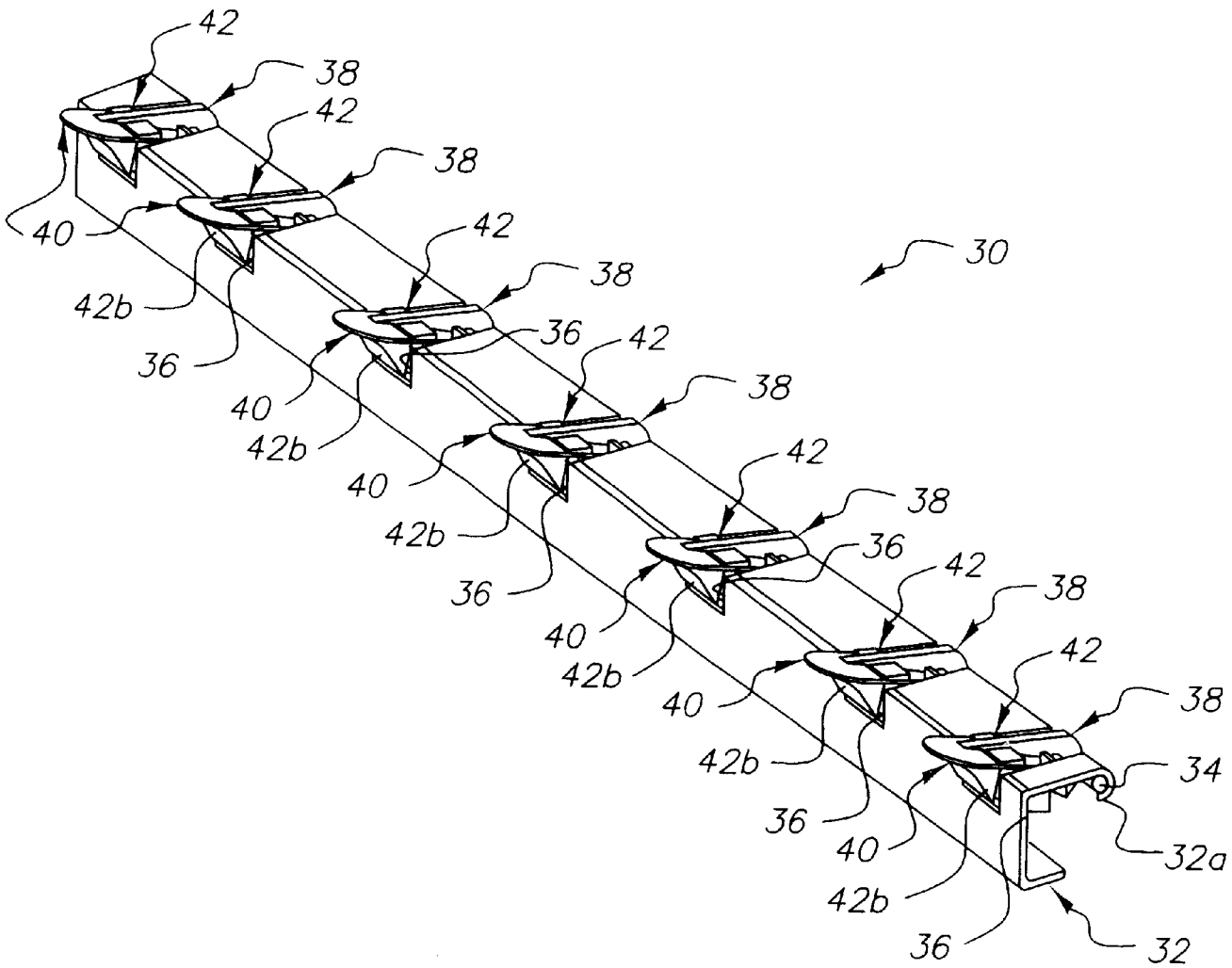
FIG. 2 is a view, in perspective, of the receiver member skive assembly of FIG. 1, with portions removed or broken away to facilitate viewing.
Figure 3:
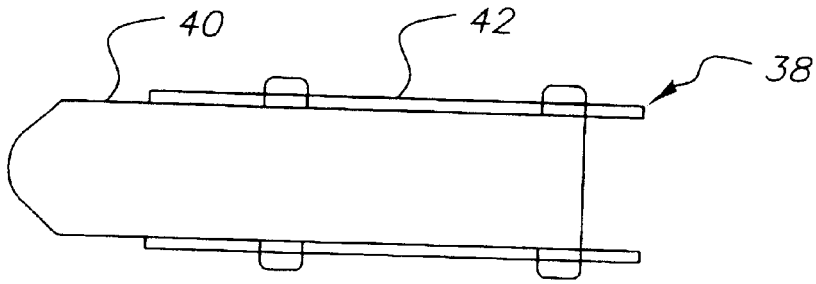
FIG. 3 is a top plan view, on an enlarged scale, of a receiver member skive finger from the skive assembly, according to this invention, as shown in FIG. 1.

The skive fingers 40, as best shown in FIGS. 1, 2, and 3, are of a particular preferred configuration best suited for engaging the roller of the fuser apparatus 10 which is relatively softer than the other nip-forming roller such that the nip shape is curved around the harder roller. Therefore, the receiver member on the exit from the nip is forced away from the skive finger-bearing softer roller. The thin flexible fingers could be placed very close to the nip (preferably 2 to 5 millimeters) under very low tip load (2 to 10 grams). The preferred skive fingers are long (free span 25 to 40 mms) and thin (0.1 to 0.13 mms). Because the skive fingers 40 are very thin, therefore, it is possible to place them very close to the fuser roller nip, and further when combined with the softer skive finger-bearing roller enables the skive fingers to work as guides rather than strippers for the receiver. Furthermore, when the skive fingers 40 are used as receiver member guides, a high tip force is not needed and thus roller surface damage is avoided. Such a skive finger arrangement works best when the harder roller of the fuser nip rollers has an air knife 50 (see FIG. 1) for the receiver release from its surface.

The air knife 50 (see FIG. 1) includes an air plenum 52 having a nozzle arrangement 54. The air knife is located in a particular relation to the skive finger assemblies 38 such that the air knife is in operative relation to the roller nip of the fuser apparatus 10. The air plenum 52 is in flow communication with a pressurized air source P. The nozzle arrangement 54 includes a plurality of nozzle jets 56 (only one shown in the drawings) which are aligned parallel to an element of the pressure roller 14. The jets 56 are directed at an angle to the pressure roller 14 so as to provide a positive air flow to strip a receiver member adhering to the pressure roller therefrom.

Figure 4:
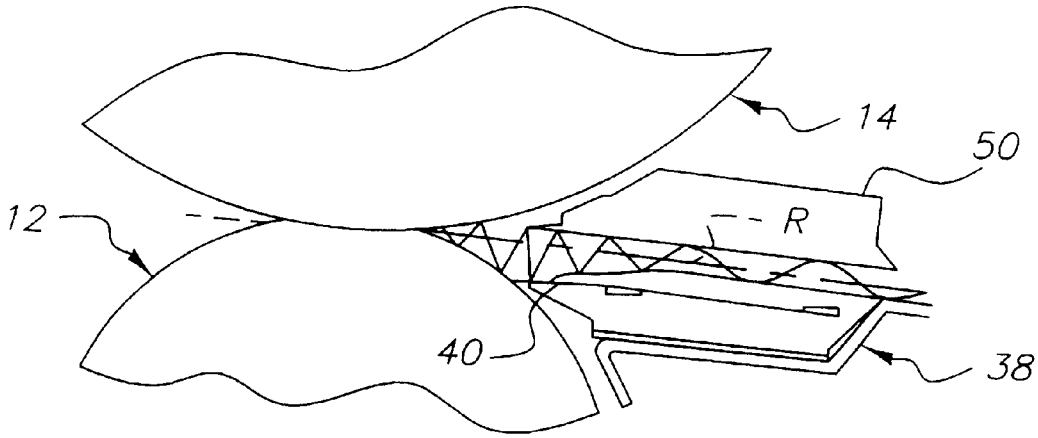
FIGS. 4, 5, 6, and 7 are respective side elevational views of the receiver member skive assembly, similar to that shown in FIG. 1, showing removal of various modes of for jammed sheets.
Figure 5:
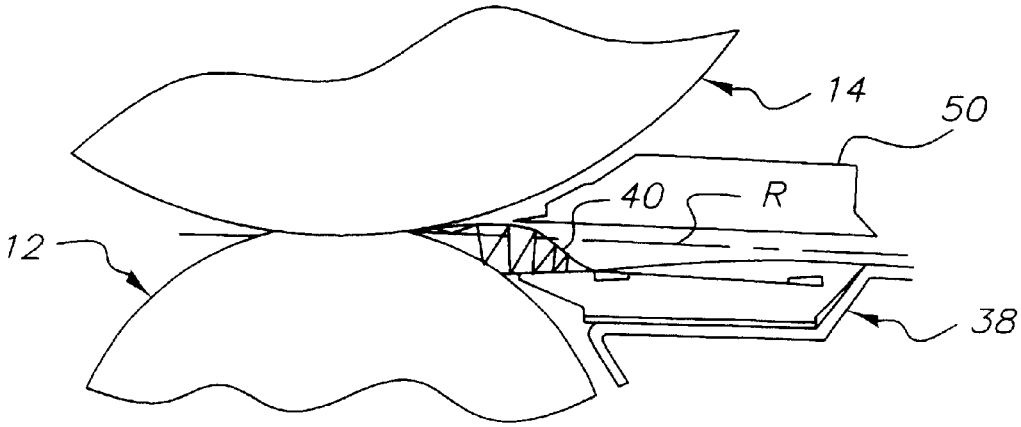
Figure 6:
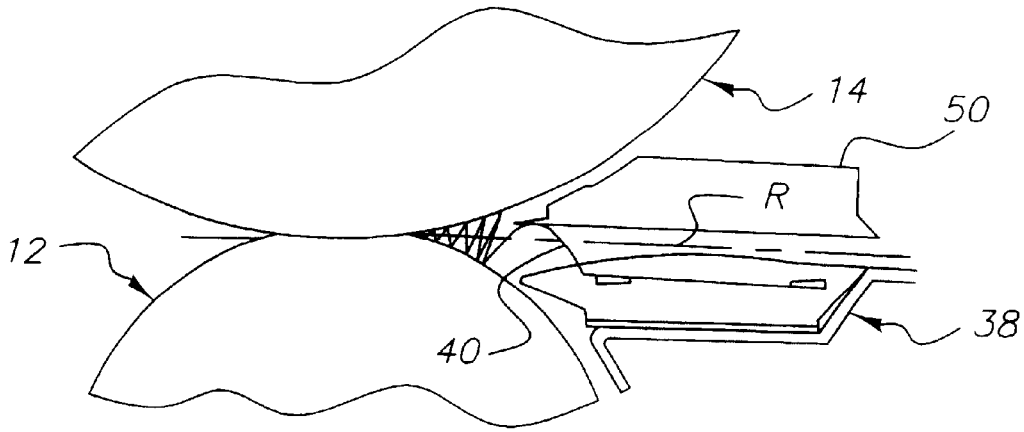
Figure 7:
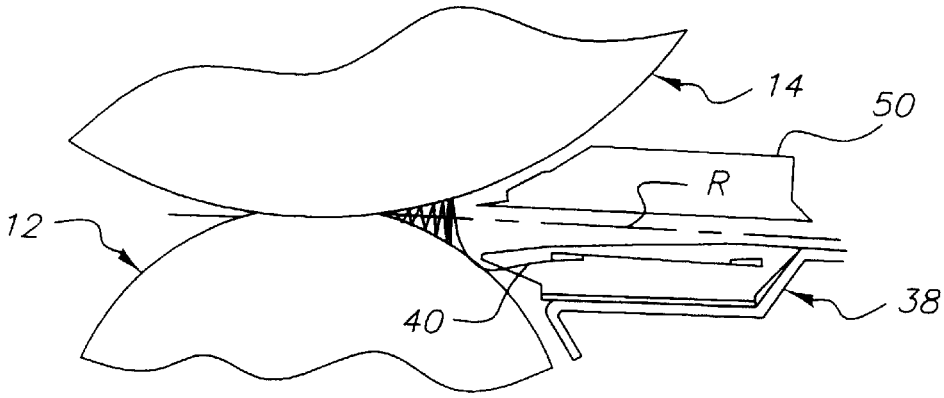

In FIGS. 4, 5, 6, and 7, various possible receiver member jam modes are depicted. In FIG. 4, an accordion type jam is represented; in FIG. 5, an underneath jam is depicted; in FIG. 6, a buckle-up jam is shown; and in FIG. 7, a buckle-down jam is represented. These possible receiver member jam scenarios were all tested, and no surface damage to either of the fuser apparatus rollers or to the skive fingers was noticed. The fuser apparatus roller wear and gouging problem is accordingly obviated by the very flexible, thin, long skive fingers 40. This is due to the fact that the skive fingers according to this invention tend to buckle under much less force than the force which would damage the surfaces of the fuser apparatus rollers.

Figure 8:
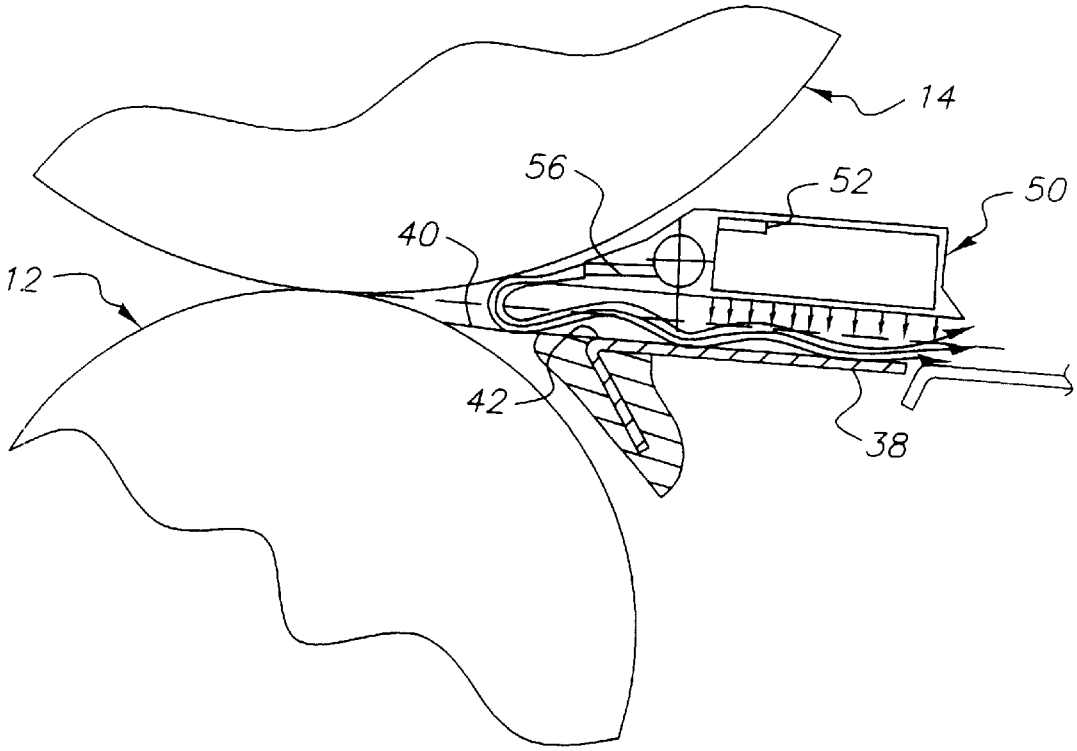
FIG. 8 is a side elevational view, on an enlarged scale, of the receiver member skive assembly, similar to that shown in FIG. 1, showing the air flow created thereby.
Figure 9:
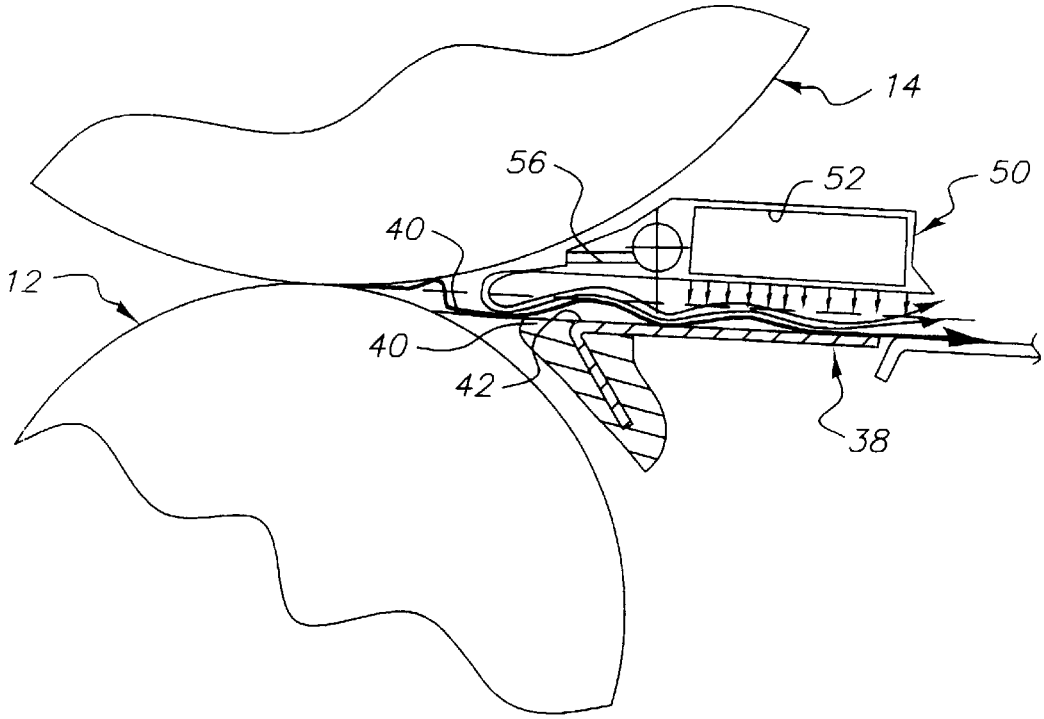
FIG. 9 is a side elevational view, on an enlarged scale, of the receiver member skive assembly, similar to that shown in FIG. 8 with a receiver member jam being removed from the fuser nip.

In FIGS. 8 and 9, the effect of the air flow from the air knife 50 is shown. While the air knife 50 serves to substantially avoid skive marks on reproductions, FIG. 8 shows the turbulent air flow of the deflected high pressure air between the air knife and the skive fingers 40 which form a receiver member guide plate with the support body 42. The effect of this deflected turbulent air flow on a receiver member is shown in FIG. 9. The receiver member, after the release from the roller 14 by airflow from the high pressure air jet 56, is deflected down towards the roller 12 and guided outwards from the fuser apparatus 10 by the skive fingers 40 and the guide plate they form with the support body 42. When the receiver member is pushed under pressure against the formed guide plate, high friction forces opposing the motion of the receiver member is generated. The friction forces act to create ripples in the receiver member, especially in thin (light) papers. High friction forces and turbulent air flow tend to negatively impact the receiver member transport (post fusing).

Figure 10:
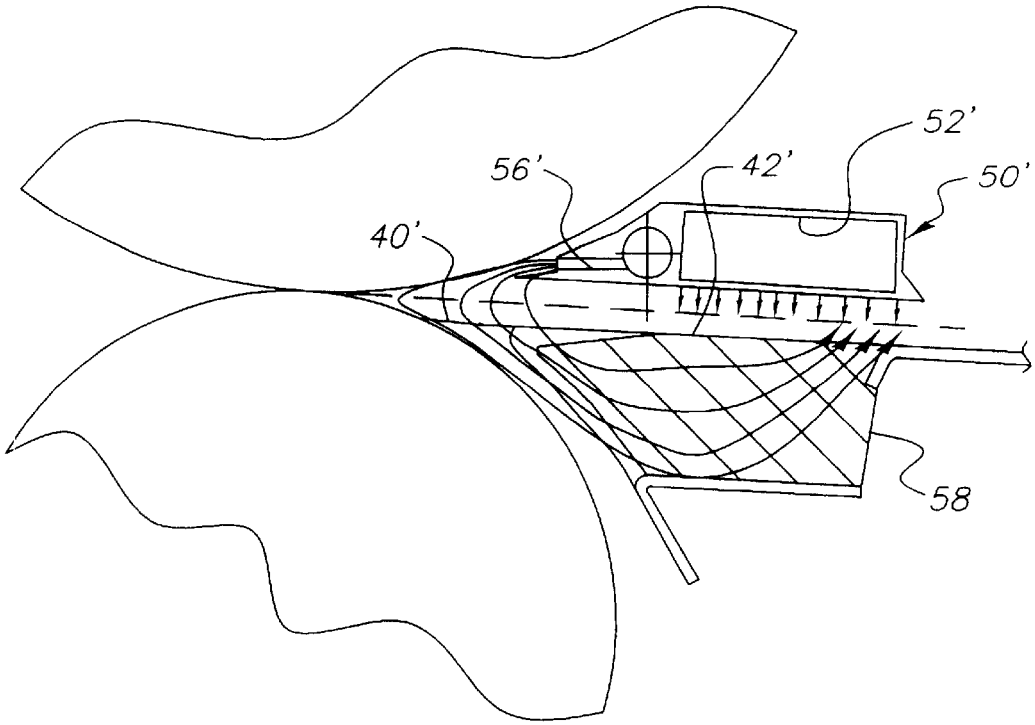
FIG. 10 is a side elevational view, on an enlarged scale, of an alternate embodiment of the receiver member skive assembly, according to this invention, to improve air flow therethrough.
Figure 11:
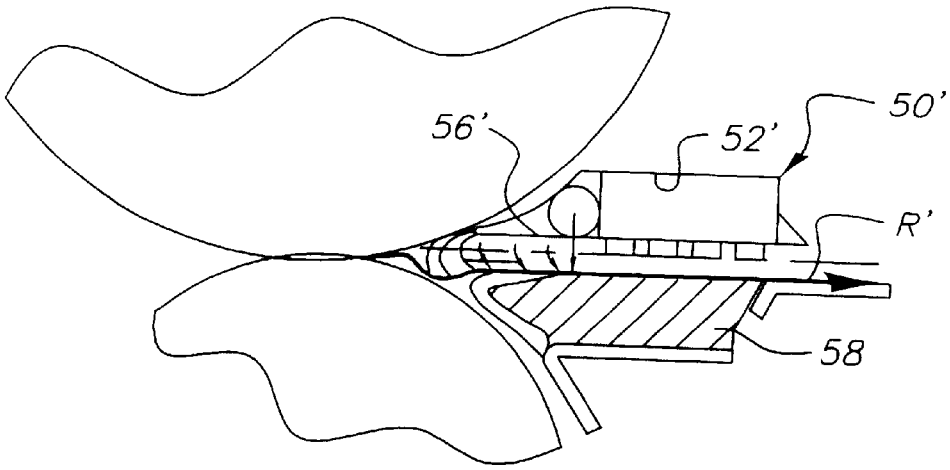
FIG. 11 is a side elevational view, on an enlarged scale, of the alternate receiver member skive assembly, according to this invention, similar to that shown in FIG. 10, with a receiver member being skived from a fuser roller.
Figure 12:
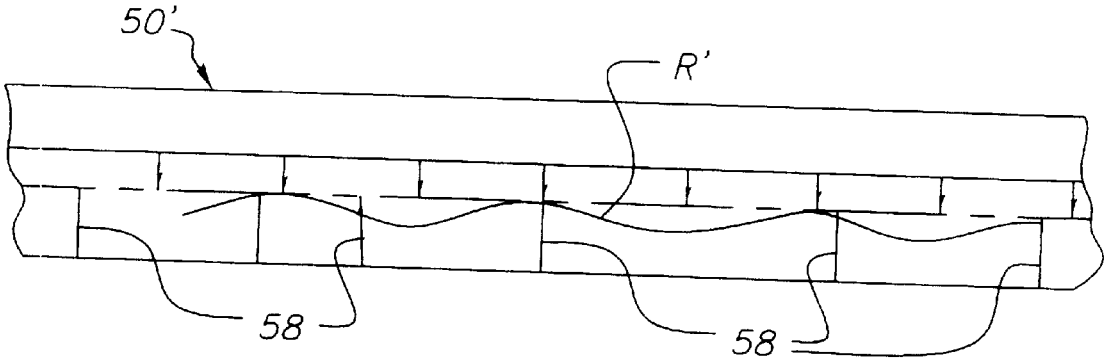
FIG. 12 is a front elevational view, on an enlarged scale, of the receiver member skive assembly, according to this invention, similar to that shown in FIG. 10, with a receiver member being skived from a fuser roller.

FIGS. 10–12 show an alternate embodiment of the air knife, designated by the numeral 50', for overcoming the aforementioned problems caused by high friction forces and turbulent air flow. The support members 42' for the skive fingers 40', together forming the receiver member guide plate, are configured to provide an extended flow path for deflected air. Thus, the air flow away from the fuser apparatus roller nip is more streamlined (see FIG. 10). Furthermore, the support member 42' includes a plurality of low friction fins 58 on either side of respective skive fingers (see FIG. 12). Accordingly, on exiting the fuser apparatus roller nip, the receiver member R' (FIGS. 11 and 12) is guided and transported over the low friction fins 58. The fins 58 not only reduce the friction forces that oppose the receiver member motion, but also corrugate the receiver member in the cross-track direction (i.e., the direction transverse to the travel direction). The corrugation serves to impart a greater degree of stiffness to the receiver member, and thus the transportation of the receiver member is very smooth as it glides over the low friction fins (waves and cockles in the receiver member are substantially prevented).

Figure 13:
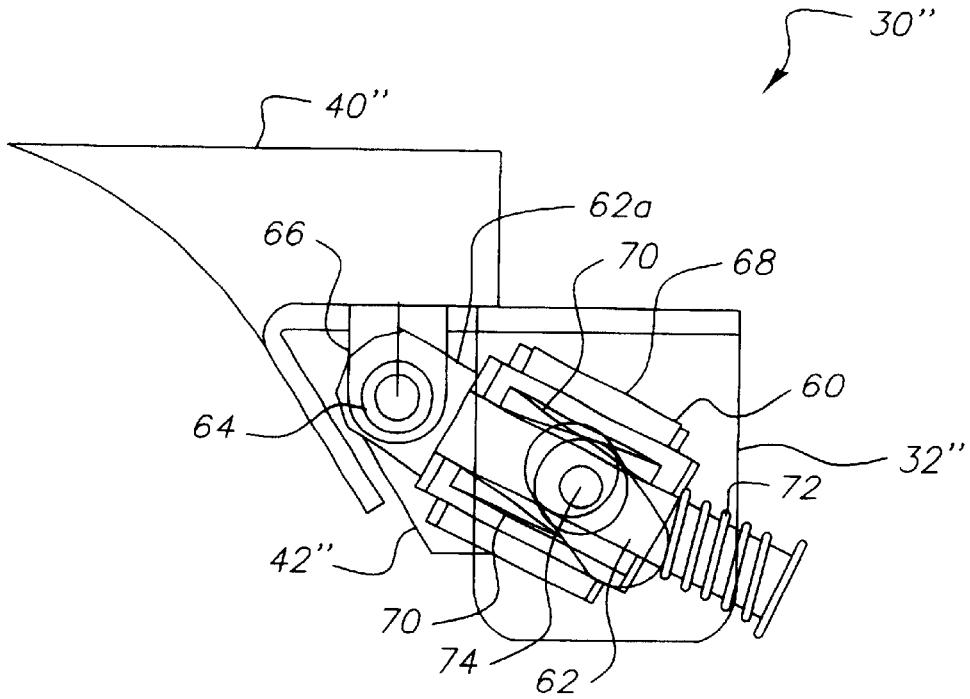
FIG. 13 is a side elevational view, on an enlarged scale, of another alternate embodiment of the receiver member skive assembly, according to this invention, showing a slide support therefor.
Figure 14:
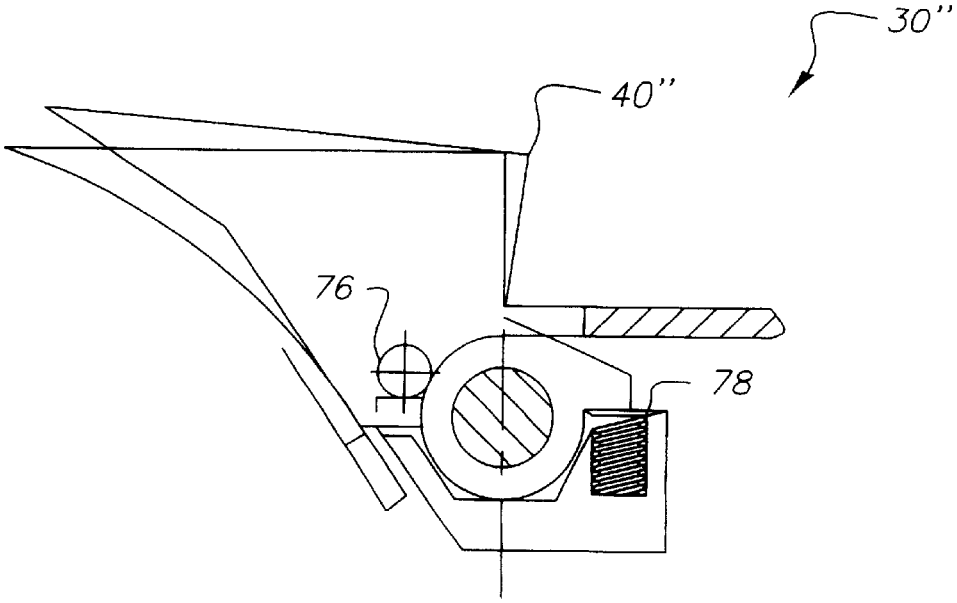
FIG. 14 is a side elevational view, on an enlarged scale, of the alternate receiver member skive assembly, according to this invention, as shown in FIG. 13, showing finger stops.

As noted above, the skive fingers 40 are held against the fusing apparatus roller by a spring force (for example spring 44 in FIG. 1). In the event of a receiver member jam, the skive fingers tend to be pushed down and into the roller surface to potentially cause damage to the roller. FIGS. 13 and 14 show an alternate embodiment of the skive assembly, designated by the numeral 30", which further serves to substantially prevent gouging of the fuser apparatus roller by the skive fingers. Each of the skive assemblies 30" has a slide mechanism 60. The slide mechanism 60 includes a mounting shaft 62 having a clevis 62*a* at one end mounted on a pin 64 for rotation about the longitudinal axis of such pin. The pin 64 is fixed in a bracket 66 connected to the frame 32" of the skive assembly 30".

A linear guide 68 is supported on the mounting shaft 62, in suitable linear bearings 70, so as to enable the linear guide to move linearly on the mounting shaft. The linear guide 68 is urged by a coil spring 72, for example, into engagement with the clevis 62*a* to properly locate the linear guide under normal operating circumstances. A respective skive finger 40" and support body 42" are fixed to the linear guide 68 via a pin 74. Accordingly, when a skive finger 40" is engaged by a receiver member and a jam condition occurs, the linear guide 68 is capable of moving linearly on the mounting shaft 62, against the urging of the spring 72, and can pivot about the pin 64.

In view of the described skive assembly 30" arrangement, according to the alternate embodiment of this invention, in the case of a receiver member jam, the force of the receiver member on the skive fingers 40" causes the linear guide 68 of the slide mechanism 60 to slide, and also rotate (change the tilt angle about pin 64) when the linear guide is retracting back or sliding, to thus clear the skive fingers from the associated fuser apparatus roller. The movement of the skive fingers due to rotation of the linear guide 68 about the pin 64 is restricted by a stopper pin 76 and a stopper plate 78 (see FIG. 14). In the case where the receiver member jam happens underneath the skive fingers 40', the skive fingers are stopped by the stopper plate 78, thus not allowing the skive fingers to pivot (clockwise in the drawings) to an extent sufficient to touch the upper roller, while enough force is generated by the jammed receiver member to push the linear guide 68 away from the rollers. Conversely, in the case where the receiver member jam happens above the skive fingers 40", the skive fingers are stopped by the stopper pin 76, thus not allowing the skive fingers to pivot (counter-clockwise in the drawings) to an extent sufficient to gouge the lower roller, while enough force is generated by the jammed receiver member to push the linear guide 68 away from the rollers. Furthermore, the slide mechanism 60 is at an inclined plane (setting angle) so that enough force of the jammed receiver member is generated along the longitudinal axis of the mounting shaft 62 to make the slide mechanism (and thus the respective skive finger) move away from the fuser apparatus rollers during a receiver member jam irrespective of whether the jam is under or above the skive fingers. The skive assembly parameters, i.e. the attack angle, the setting angle, and the tilt angle, are optimized based on the fuser apparatus roller size and the nip geometry.

Figure 15:
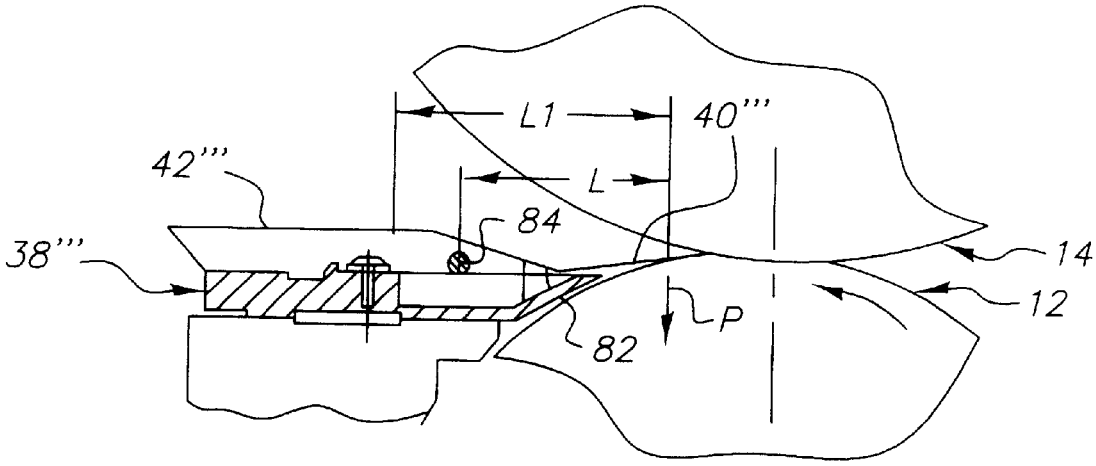
FIG. 15 is a side elevational view, on an enlarged scale, of yet another alternate embodiment of the receiver member skive assembly, according to this invention.
Figure 16:
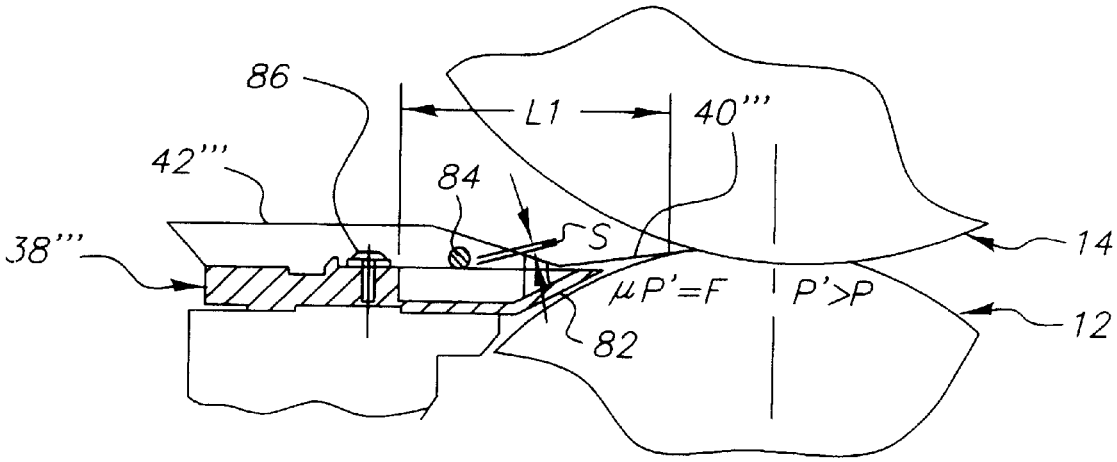
FIGS. 16–18 are side elevational views, on an enlarged scale, of the alternate receiver member skive assembly according to this invention, as shown in FIG. 15, respectively showing operating conditions thereof.
Figure 17:
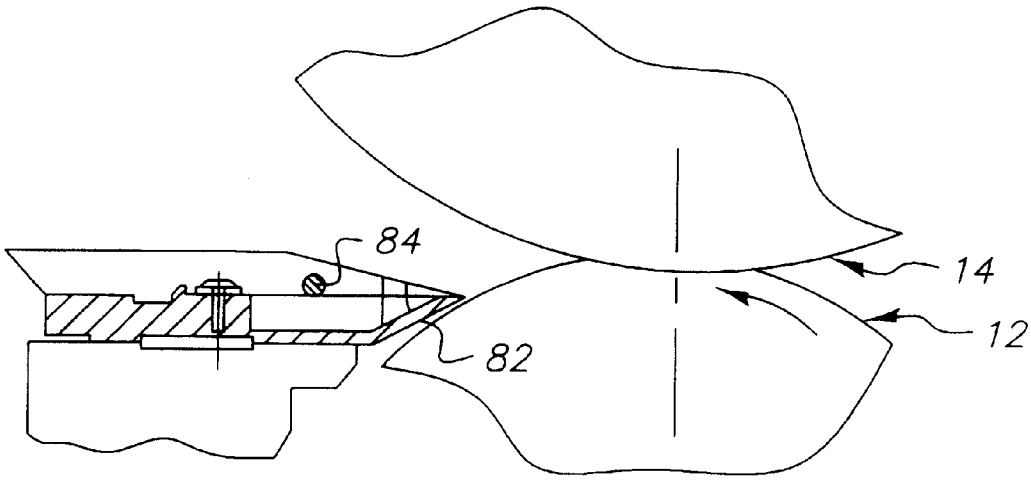
Figure 18:
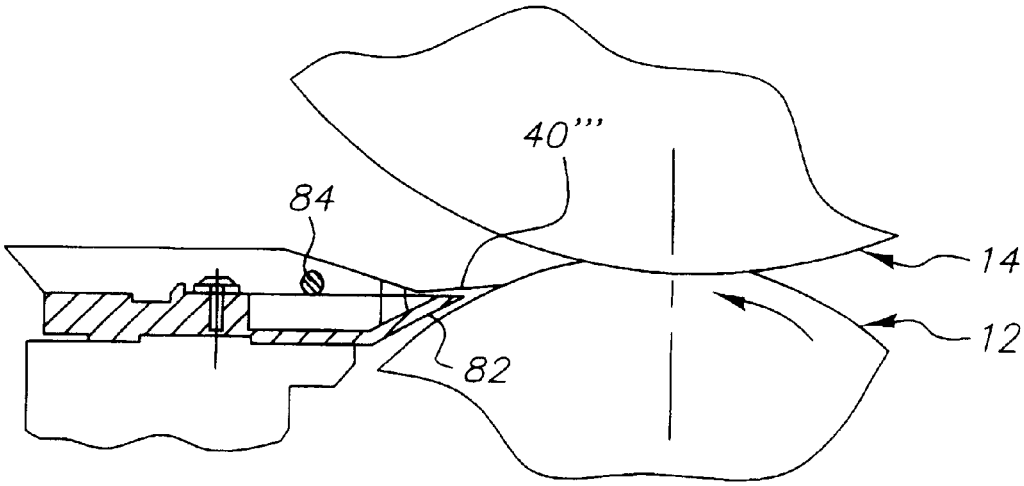

FIGS. 15–18 demonstrate schematically the critical parameters and method for determining the preferred configuration for a further embodiment of the skive fingers designated 40'". At the normal setting shown in FIG. 15, the skive finger tip force (P) is determined by the deflection of the finger as it presses into the elastomer cover of the fuser apparatus roller 12. The finger tip force (P) generates a friction force (F) due to the resistance between the skive finger and the roller as the roller rotates in the direction in opposition to the finger tip. The friction force is expressed by the equation: $F=\mu P$, where $\mu$ is the coefficient of friction between the skive finger 40'" and the elastomer cover. In the normal setting condition of the skive finger to the roller to strip the receiver member off the roller, the finger strength (S) should be greater than the friction force (F) (FIG. 16). In the case of a receiver member jam or receiver member sticking to the top of the finger (Abnormal Conditions), an additional force would be generated which would make the friction force higher than the skive finger strength. Without the considerations of this invention, this would make the skive finger bend or dig into the fuser apparatus roller surface. Of course, such action would be detrimental in that either the skive finger or the roller surface would be damaged.

These different Abnormal Condition scenarios (as defined above) are shown in FIGS. 4–7, and defined by the equation:

$S<F=\mu P+\Delta F$; where $\Delta F$ is the additional force.

In these Abnormal Conditions, from this equation, it can be seen that if the skive finger tip force were to be reduced, the bending of the skive fingers or digging of the roller surface can be avoided. The concept disclosed in this invention uses the Statically Indeterminate Structure: The skive finger tip force is reduced whenever the skive finger is pushed back due to an increased load (friction force) during receiver member jams or receiver members sticking to the skive fingers. The skive finger tip force reduction occurs because the skive finger free length increases from L to L1 (as shown in FIG. 15; L1>L). That is to say, the skive finger's normal free length L is measured from the tip of the skive finger to the mid-support point provided by a cross-pin 84. On the other hand during a jam, the skive finger moves such that it separates from the cross-pin 84. Thus the free length L for the calculation, is measured from the tip of the skive finger to the screw connection 86 with the support body 42'". Further, there is also provided a bottom support 82 for the finger to avoid large bending or buckling of the finger and thus reducing the chances of skive finger damage or roller surface gouging.

In the normal setting, the skive finger 40'" is pressed against the fuser apparatus roller 12 and the cross-pin 84 to generate a predetermined tip force P (see FIG. 15). The skive finger tip force can be obtained (substantially approximately) by the simple beam deflection calculation: $P=\delta 3EI/L^3$ Where: E: Modulus of Elasticity I: Moment of Inertia P: Tip Force L: Beam Length δ: Deflection As discussed above, in the case where a receiver member jam or a receiver member sticking to the skive finger (also, would be appropriate for a reduced oil rate on the roller) would increase the friction forces, the skive finger would be pushed backward to bend more. As the finger bends more than when in the initial setting (FIG. 15), the skive finger 40'" separates from the cross-pin 84. The free span of the skive finger (as discussed above) will increase from L to L1 (L1>L); therefore the skive finger tip force, as calculated by using the formula above, decreases because of the increased free length of the finger. Furthermore, the decrease in the skive finger tip force will decrease the frictional forces and consequently the finger will try to return to its original setting (see FIG. 17). However, in the case of a receiver member jam or receiver member sticking to the skive finger (when the oil depletion continues), the friction forces will not decrease and further bending of the skive finger may then occur. On any such further bending, the skive finger 40'" will eventually come to rest on the bottom support 82 (see FIG. 18) which would prevent the skive finger from buckling and thus prevent any damage to the skive fingers or to the roller.

The invention has been described in detail with particular reference to certain preferred embodiments thereof, but it will be understood that variations and modifications can be effected within the spirit and scope of the invention.

What is claimed is:

1. A fuser apparatus having a pair of rollers in nip relation to transport a receiver member therebetween and to permanently fix a marking particle image to such receiver member, and a skive mechanism for stripping a receiver member adhering to either of said fuser apparatus rollers from said roller, said skive mechanism comprising:

a frame located in spaced relation with one of said rollers of said pair of fuser apparatus rollers, a plurality of skive assemblies mounted on said frame, each of said skive assemblies including a skive finger and a support body for supporting said skive finger in operative relation to said one of said rollers, said skive finger being an elongated, thin, flexible member of a length in the range of 25–40 mms, and a thickness in the range of 0.1–.013 mms, whereby, upon a jam of a receiver member in said fuser apparatus, damage to said associated fuser apparatus roller is substantially prevented; and an air plenum in operative relation to the other of said pair of rollers of said fuser apparatus rollers, said air plenum having a nozzle arrangement directed at an angle to said fuser apparatus roller associated with said air plenum so as to provide a positive air flow to substantially assure that a receiver member adhering to such fuser apparatus roller is stripped therefrom.

2. The fuser apparatus skive mechanism according to claim 1 wherein said respective skive fingers are located in the range of 2–5 mms from said fuser apparatus roller nip, and have a tip load on such associated fuser apparatus roller in the range of 2–10 grams.

3. The fuser apparatus skive mechanism according to claim 1 wherein each of said support bodies is mounted on a pivot, and is urged in a direction about said pivot to locate said respective skive fingers in engagement with said associated fuser apparatus roller.

4. The fuser apparatus skive mechanism according 1to claim 1 wherein said support bodies for said skive fingers are configured to provide an extended flow path for deflected air, whereby air flow away from the fuser apparatus roller nip is streamlined.

5. The fuser apparatus skive mechanism according to claim 4 wherein said respective support bodies of said skive assemblies include a plurality of low friction fins on either side of said skive fingers so that on exiting the fuser apparatus roller nip, a receiver member is guided and transported over said low friction fins whereby friction forces that oppose the receiver member motion are reduced and said receiver member is corrugated in the cross-track direction to impart a greater degree of stiffness to said receiver member, and thus in transportation of said receiver member waves and cockles are substantially prevented.

6. The fuser apparatus skive mechanism according to claim 1 wherein said respective skive assemblies include a slide mechanism having a linear guide capable of moving linearly to slide, and also rotate to clear said skive fingers from said associated fuser apparatus roller when a jam condition occurs.

7. The fuser apparatus skive mechanism according to claim 6 wherein said slide mechanism includes a mounting shaft having a clevis at one end mounted on a first pin for rotation about the longitudinal axis of such first pin, said first pin being fixed in a bracket connected to said frame of said skive assembly.

8. The fuser apparatus skive mechanism according to claim 7 wherein said linear guide is supported on said mounting shaft in linear bearings so as to enable the linear guide to move linearly on the mounting shaft, a coil spring for urging said linear guide into engagement with said clevis to properly locate the linear guide under normal operating circumstances, a respective skive finger and support body being fixed to said linear guide via a second pin whereby, when a skive finger is engaged by a receiver member and a jam condition occurs, said linear guide moves linearly on said mounting shaft, against the urging of said spring, and pivots about said first pin.

9. The fuser apparatus skive mechanism according to claim 8 wherein the movement of said skive fingers due to rotation of said linear guide in a predetermined direction about said second pin is restricted by a stopper plate, such that when the receiver member jam happens underneath said skive fingers, said skive finger movement is stopped by the stopper plate, thus not allowing said skive fingers to pivot about said second pin to an extent sufficient to touch the upper of said fuser apparatus rollers, while enough force is generated by such jammed receiver member to push said linear guide away from said fuser apparatus rollers.

10. The fuser apparatus skive mechanism according to claim 8 wherein the movement of said skive fingers due to rotation of said linear guide in a predetermined direction about said second pin is restricted by a stopper pin, such that when the receiver member jam happens above said skive fingers, said skive finger movement is stopped by the stopper pin, thus not allowing said skive fingers to pivot about said second pin to an extent sufficient to gouge the lower of said fuser apparatus rollers, while enough force is generated by such jammed receiver member to push said linear guide away from said fuser apparatus rollers.

11. The fuser apparatus skive mechanism according to claim 8 wherein the movement of said skive fingers due to rotation of said linear guide in a first predetermined direction about said second pin is restricted by a stopper plate, such that when the receiver member jam happens underneath said skive fingers, said skive finger movement is stopped by the stopper plate, thus not allowing said skive fingers to pivot about said second pin to an extent sufficient to touch the upper of said fuser apparatus rollers, while enough force is generated by such jammed receiver member to push said linear guide away from said fuser apparatus rollers; and wherein the movement of said skive fingers due to rotation of said linear guide in a second predetermined direction, opposite said first predetermined direction, about said second pin is restricted by a stopper pin, such that when the receiver member jam happens above said skive fingers, said skive finger movement is stopped by the stopper pin, thus not allowing said skive fingers to pivot about said second pin to an extent sufficient to gouge the lower of said fuser apparatus rollers, while enough force is generated by such jammed receiver member to push said linear guide away from said fuser apparatus rollers.

12. The fuser apparatus skive mechanism according to claim 1 wherein each respective skive finger supports includes a connector attaching a skive finger to said support body adjacent to one end of said skive finger, and a cross-pin providing mid-support point for said skive finger, whereby during receiver member jams or receiver members sticking to said skive fingers, said skive finger moves away from said cross-pin so that skive finger tip force reduction occurs because skive finger free length increases from the length measured from the tip of said skive finger to said mid-support point provided by said cross-pin to the length measured from the tip of the skive finger to said connection to said support body.

13. The fuser apparatus skive mechanism according to claim 12 wherein each respective skive finger support further includes a bottom support for said skive finger to avoid large bending or buckling of said skive finger, thereby reducing the chances of skive finger damage or roller surface gouging.

14. A fuser apparatus for a reproduction apparatus, said fuser apparatus comprising:

a heated fuser roller;

a pressure roller in nip relation with said heated fuser roller; and a skive mechanism including a frame located in spaced relation with one of said rollers of said pair of fuser apparatus rollers, a plurality of skive assemblies mounted on said frame, each of said skive assemblies including a skive finger and a support body for supporting said skive finger in operative relation to said one of said rollers, said skive finger being an elongated, thin, flexible member of a length in the range of 25–40 mms, and a thickness in the range of 0.1–0.13 mms; and wherein said respective skive fingers are located in the range of 2–5 mms from said fuser apparatus roller nip, and have a tip load on such associated fuser apparatus roller in the range of 2–10 grams, whereby, upon a jam of a receiver member in said fuser apparatus, damage to said associated fuser apparatus roller is substantially prevented, and an air plenum in operative relation to the other of said pair of rollers of said fuser apparatus rollers, said air plenum having a nozzle arrangement directed at an angle to said fuser apparatus roller associated with said air plenum so as to provide a positive air flow to substantially assure that a receiver member adhering to such fuser apparatus roller is stripped therefrom.

15. The fuser apparatus according to claim 14 wherein said support members bodies for said skive fingers are configured to provide an extended flow path for deflected air, whereby air flow away from the fuser apparatus roller nip is more streamlined; and wherein said respective support bodies of said skive assemblies include a plurality of low friction fins on either side of said skive fingers so that on exiting the fuser apparatus roller nip, a receiver member is guided and transported over said low friction fins whereby friction forces that opposes the receiver member motion are reduced and said receiver member is corrugated in the cross-track direction to impart a greater degree of stiffness to said receiver member, and thus in transportation of said receiver member waves and cockles are substantially prevented.

16. The fuser apparatus according to claim 14 wherein said respective skive assemblies include a slide mechanism having a linear guide capable of moving linearly to slide, and also rotate to clear said skive fingers from said associated fuser apparatus roller when a jam condition occurs, said slide mechanism including a mounting shaft having a clevis at one end mounted on a first pin for rotation about the longitudinal axis of such first pin, said first pin being fixed in a bracket connected to said frame of said skive assembly, said linear guide being supported on said mounting shaft in linear bearings so as to enable the linear guide to move linearly on the mounting shaft, a coil spring for urging said linear guide, into engagement with said clevis to properly locate the linear guide under normal operating circumstances, a respective skive finger and support body being fixed to said linear guide via a second pin whereby, when a skive finger is engaged by a receiver member and a jam condition occurs, said linear guide moves linearly on said mounting shaft, against the urging of said spring, and pivots about said first pin.

17. The fuser apparatus according to claim 16 wherein the movement of said skive fingers due to rotation of said linear guide in a first predetermined direction about said second pin is restricted by a stopper plate, such that when the receiver member jam happens underneath said skive fingers, said skive finger movement is stopped by the stopper plate, thus not allowing said skive fingers to pivot about said second pin to an extent sufficient to touch the upper of said fuser apparatus rollers, while enough force is generated by such jammed receiver member to push said linear guide away from said fuser apparatus rollers; and wherein the movement of said skive fingers due to rotation of said linear guide in a second predetermined direction, opposite said first predetermined direction, about said second pin is restricted by a stopper pin, such that when the receiver member jam happens above said skive fingers, said skive finger movement is stopped by the stopper pin, thus not allowing said skive fingers to pivot about said second pin to an extent sufficient to gouge the lower of said fuser apparatus rollers, while enough force is generated by such jammed receiver member to push said linear guide away from said fuser apparatus rollers.

18. The fuser apparatus according to claim 14 wherein said each respective skive finger supports includes a connector attaching a skive finger to said support body adjacent to one end of said skive finger, and a cross-pin providing mid-support point for said skive finger, whereby during receiver member jams or receiver members sticking to said skive fingers, said skive finger moves away from said cross-pin so that skive finger tip force reduction occurs because skive finger free length increases from the length measured from the tip of said skive finger to said mid-support point provided by said cross-pin to the length measured from the tip of the skive finger to said connection to said support body; and wherein each respective skive finger support further includes a bottom support for said skive finger to avoid large bending or buckling of said skive finger, thereby reducing the chances of skive finger damage or roller surface gouging.

* * * * *